US011077335B2

(12) United States Patent
McRann et al.

(10) Patent No.: US 11,077,335 B2
(45) Date of Patent: Aug. 3, 2021

(54) EXERCISE WRIST AID

(71) Applicants: Aaron Wayne McRann, Penticton (CA); Kerrie Louise McRann, Penticton (CA); Owen Saunders McRann, Penticton (CA); Spencer Davis McRann, Penticton (CA)

(72) Inventors: Aaron Wayne McRann, Penticton (CA); Kerrie Louise McRann, Penticton (CA); Owen Saunders McRann, Penticton (CA); Spencer Davis McRann, Penticton (CA)

( * ) Notice: Subject to any disclaimer, the term of this patent is extended or adjusted under 35 U.S.C. 154(b) by 94 days.

(21) Appl. No.: 16/577,582

(22) Filed: Sep. 20, 2019

(65) Prior Publication Data

US 2020/0094102 A1 Mar. 26, 2020

Related U.S. Application Data

(60) Provisional application No. 62/735,077, filed on Sep. 22, 2018.

(51) Int. Cl.

| | |
|---|---|
| ***A63B 21/00*** | (2006.01) |
| ***A63B 23/035*** | (2006.01) |
| ***A63B 23/12*** | (2006.01) |
| ***A63B 71/00*** | (2006.01) |
| ***A63B 21/16*** | (2006.01) |

(52) U.S. Cl.

CPC ..... *A63B 21/4035* (2015.10); *A63B 21/169* (2015.10); *A63B 23/03533* (2013.01); *A63B 23/1218* (2013.01); *A63B 23/1236* (2013.01); *A63B 71/0036* (2013.01); *A63B 2225/096* (2013.01)

(58) Field of Classification Search

CPC . A63B 23/1218; A63B 23/1236; A63B 23/16; A63B 69/0048; A63B 21/4035

See application file for complete search history.

(56) References Cited

U.S. PATENT DOCUMENTS

| | | | |
|---|---|---|---|
| 3,115,338 | A | 12/1963 | Acs et al. |
| 4,351,525 | A | 9/1982 | Rozenblad |
| 4,610,448 | A | 9/1986 | Hill |
| 5,230,684 | A | 7/1993 | Wallisch |
| 5,466,206 | A | 11/1995 | Fleming |
| 5,607,380 | A | 3/1997 | Duty |
| 5,741,206 | A | 4/1998 | Anastasi |

(Continued)

OTHER PUBLICATIONS

Amazon listing for "XXL Double Hander (Simple) | Bolt-on Rock Climbing Holds | Red" by Atomik Climbing Holds (Year: 2014).*

*Primary Examiner* — Jennifer Robertson

(57) ABSTRACT

An exercise device characterized by a wide hand surface (1) positioned at a downward angle with a design that allows the user to grip the underside (3) for greater stability and to position the hands in any direction necessary to perform exercises with reduced strain on the wrists and palms. The large surface area of the hand surface comfortably fits an adult palm to eliminate painful pressure points in the palm. The downward angle of the hand surface decreases the angle between the back of the hand and the forearm found in a traditional push-up position to eliminate strain associated with exercises like push-ups, planks, mountain climbers and even chest dips. The ability to grip the underside of the hand surface provides additional stability during exercise.

13 Claims, 17 Drawing Sheets

(56) References Cited

U.S. PATENT DOCUMENTS

| | | | | |
|---|---|---|---|---|
| 6,471,623 | B1 | 10/2002 | Lin et al. | |
| 7,063,646 | B1 | 5/2006 | Slimi | |
| 9,314,662 | B1 | 4/2016 | Willison | |
| 2006/0014615 | A1 | 1/2006 | Godbold | |
| 2006/0089241 | A1 | 4/2006 | Klein et al. | |
| 2009/0124471 | A1 | 5/2009 | Storch et al. | |
| 2013/0324382 | A1* | 12/2013 | Wilson ..... | A63B 23/0211 482/142 |
| 2014/0207039 | A1 | 7/2014 | Lane | |
| 2018/0214733 | A1 | 8/2018 | DeNunzio | |

* cited by examiner

EXERCISE WRIST AID

FIELD OF INVENTION

This invention relates to exercise equipment.

BACKGROUND

The invention relates to the field of exercise, sports and training equipment and specifically addresses the potential harm which may be caused to a person who does push ups, mountain climbers, planks, dips and other similar exercise which cause strain on the wrist by placing all or most of the user's weight on their palms and impinging the wrist because of the angle between the forearm and the back of the hand. Additionally, the device may also provide a mechanism for hanging the device from a wall or ceiling so that the user may expand the range of exercises that may be accomplished with said device to include exercises like pull ups and grip strengthening exercises.

Push ups, planks, and mountain climbers are examples of common exercises that require a person to position their body with palms on the floor, with the torso and legs fully extended so that the entire weight of the body is carried on the palms and toes. The arms are straight and fully extended in the starting position. For push ups, specifically, the person will lower their body towards the floor by bending the arms at the elbows and then raise themselves back up to the starting position by straightening the arms. The plank and mountain climber exercises involve assuming the starting position of the push up, but keeping the arms straight for the duration of the exercise. The plank exercise requires the person to use the core muscles of the torso to maintain the extended body position. The mountain climber exercise involves maintaining the push up starting position while alternately raising each knee towards the chest, simulating the motion of climbing a steep slope.

An exercise with a similar hand position, but involving the use of other equipment, is the chest dip, which requires the user to place their palms on horizontal bars and hold themselves in the air with the arms perpendicular to the floor (the starting position). The user lowers their body by betiding the arms at the elbow until the upper arm is parallel to the floor and the forearm remains perpendicular to the floor. The user then activates the chest and other upper body muscles to raise themselves back up to the starting position. When the upper arm is parallel to the floor and the forearm remains perpendicular the wrist is impinged in a way similar to the push up position.

Doing a push up, plank, chest dip, or other body weight exercise where the hands are parallel to the floor and the forearms are perpendicular to the floor may cause pain and excessive strain to the wrists and palms. This limits the number of repetitions or the amount of time that the user can perform these activities and may have long term health consequences if not addressed. In addition, individuals who have had previous injuries to one or both wrists may no longer have the ability to assume the push up position because of the severe strain on the wrist during exercise.

SUMMARY OF THE INVENTION

The apparatus, in all its embodiments, addresses the challenges of performing exercises that may cause wrist pain by providing a mechanism that allows for a wide hand surface to accommodate the entire width of the palm for which said hand surface is angled downward to an ergonomically appropriate degree to increase the angle, and potentially reduce impingement, of the wrists. Additionally, said hand surface is slightly convex on the top side to comfortably fit the palm. The front edge of said hand surface is convex to allow the fingers to curl around and then grip the underside of the hand surface. This allows the user's fingers to firmly grip the device. This strong, positive grip on the device may improve stability during exercise.

The hand surface is integrated with a stable base that supports the user's weight, provides stability during exercise, and keeps the user's hands slightly above the floor. The base may include a slot design at the front and back of said base to allow for the device to be mounted to a wall or ceiling. When the device is mounted to the wall or ceiling the user may perform exercises that require hanging or pulling by their hands or fingers.

DETAILED DESCRIPTION OF THE INVENTION

Figure 1:
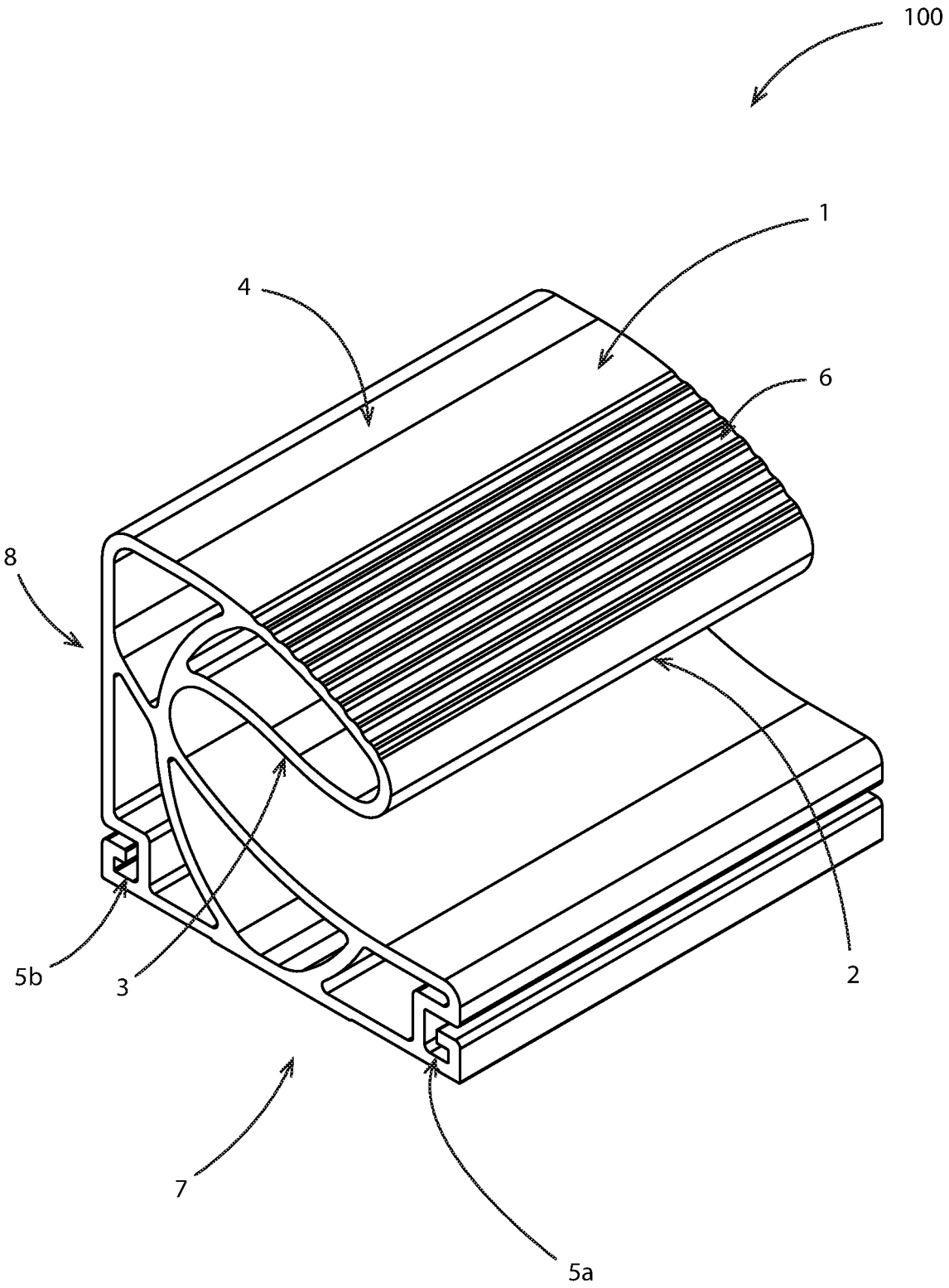
FIG. 1 is a front isometric view of the apparatus of a dimension designed for one hand.
Figure 2:
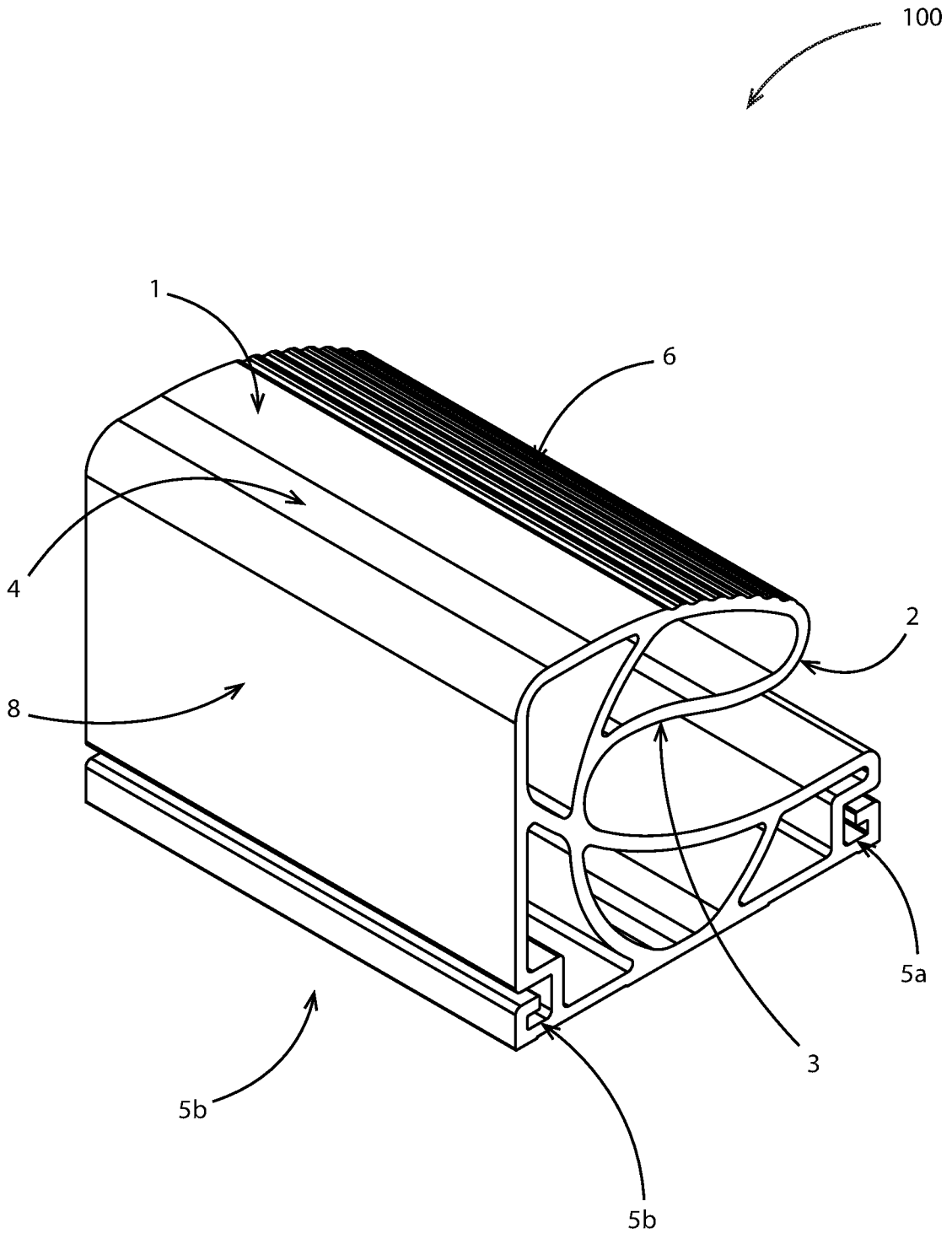
FIG. 2 is a rear isometric view of the apparatus of a dimension designed for one hand.
Figure 3:
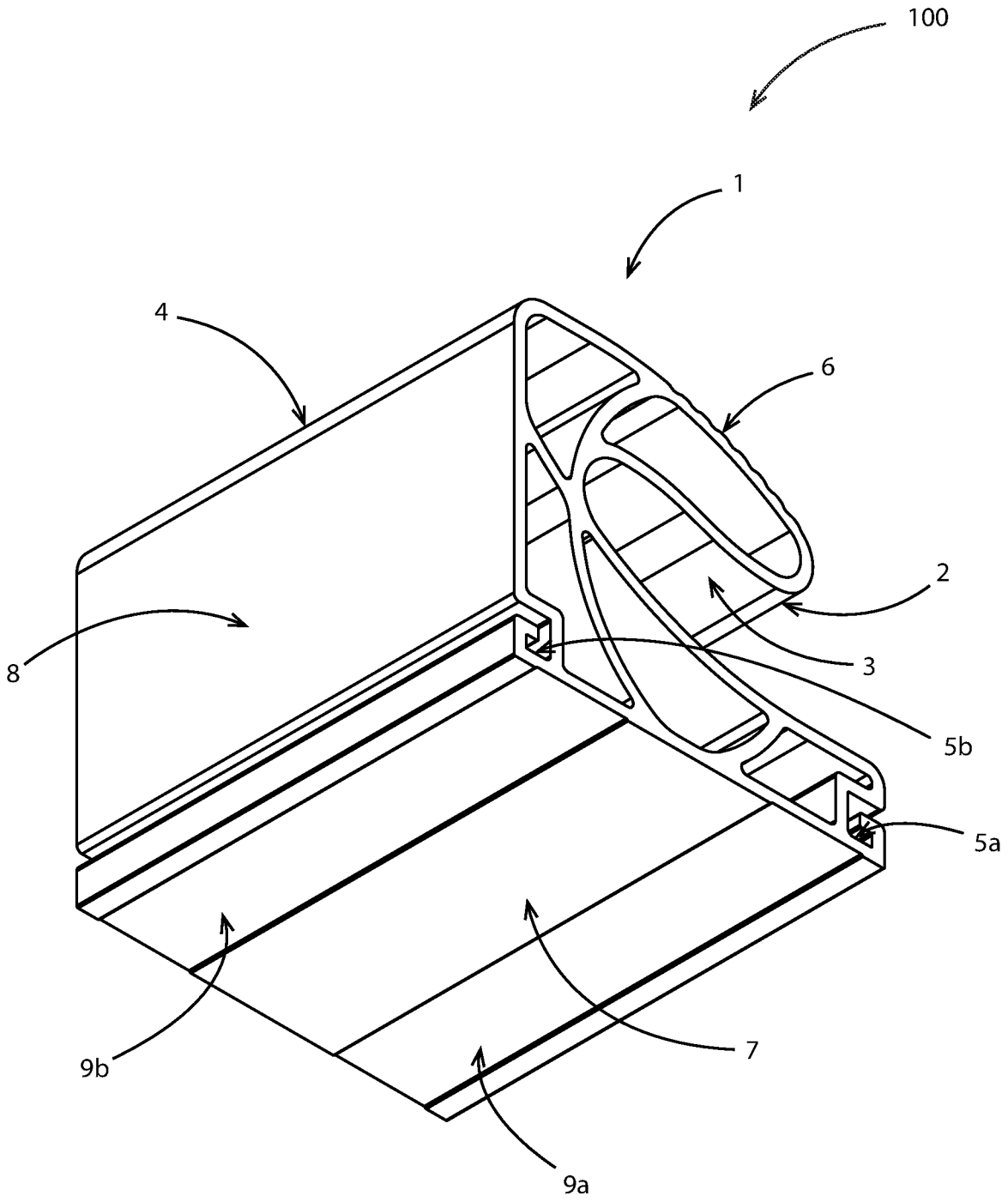
FIG. 3 is an isometric view of the bottom of the apparatus of a dimension designed for one hand.
Figure 4:
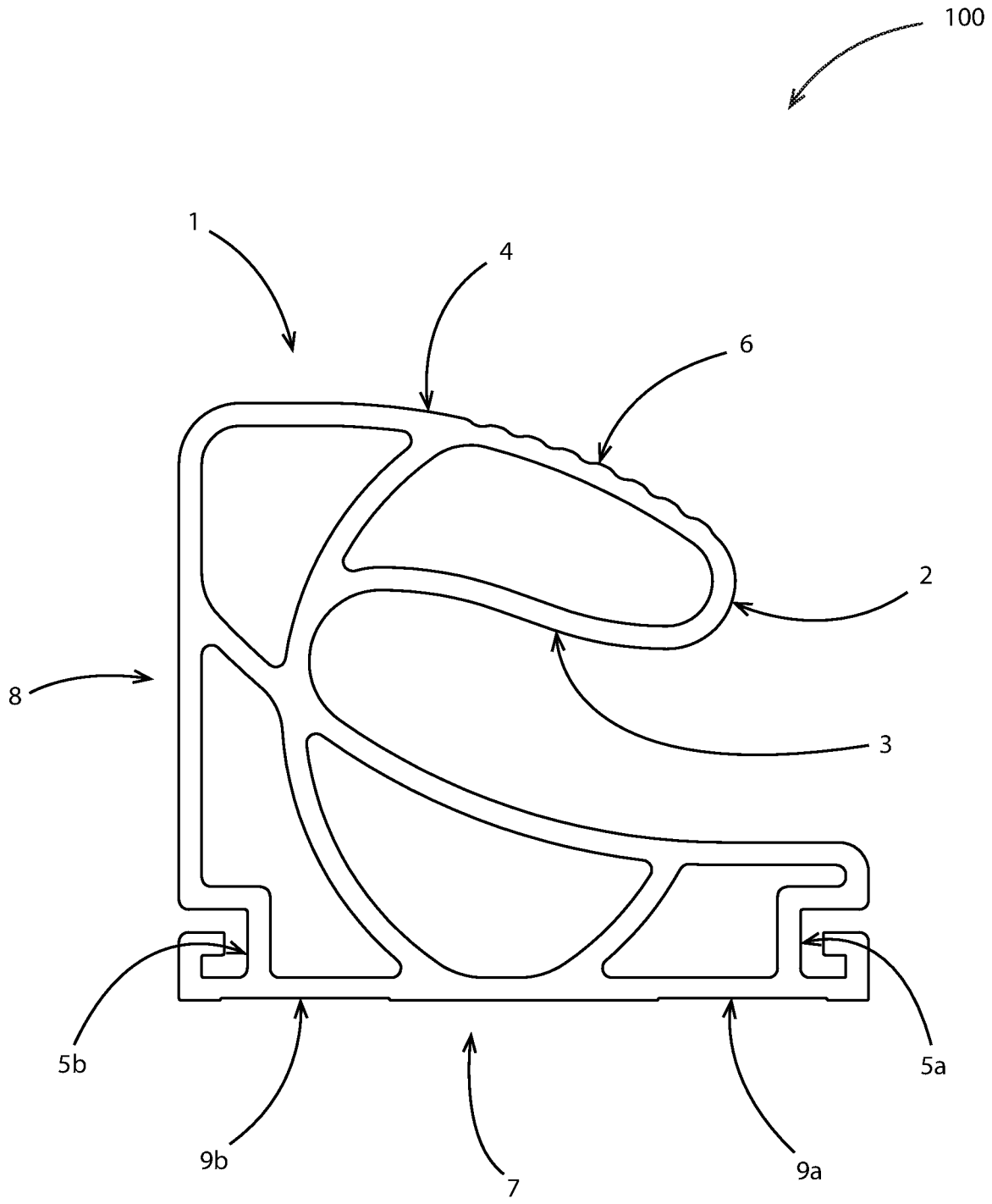
FIG. 4 is a side view of the apparatus.
Figure 5:
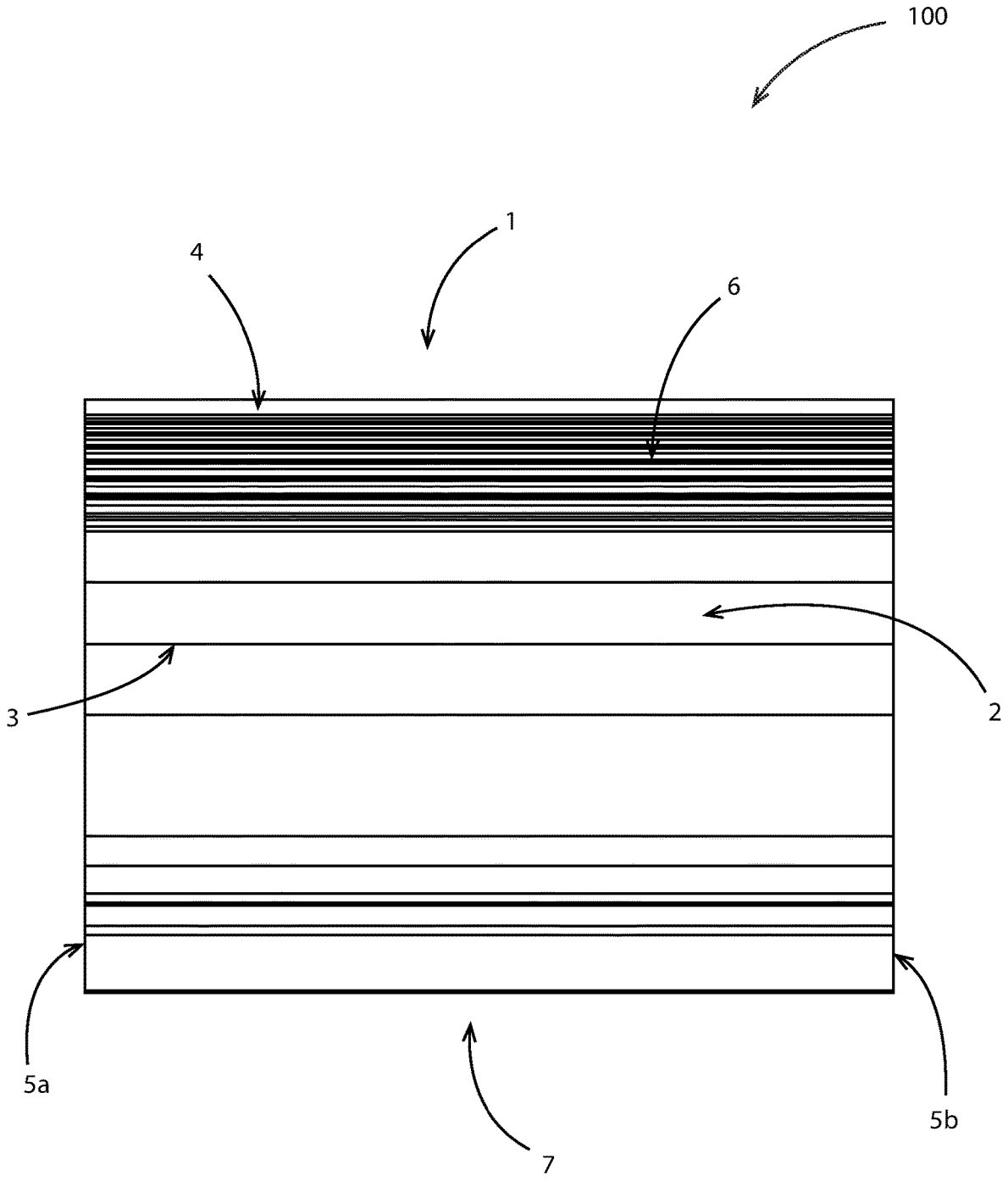
FIG. 5 is a view of the back of the apparatus.
Figure 6:
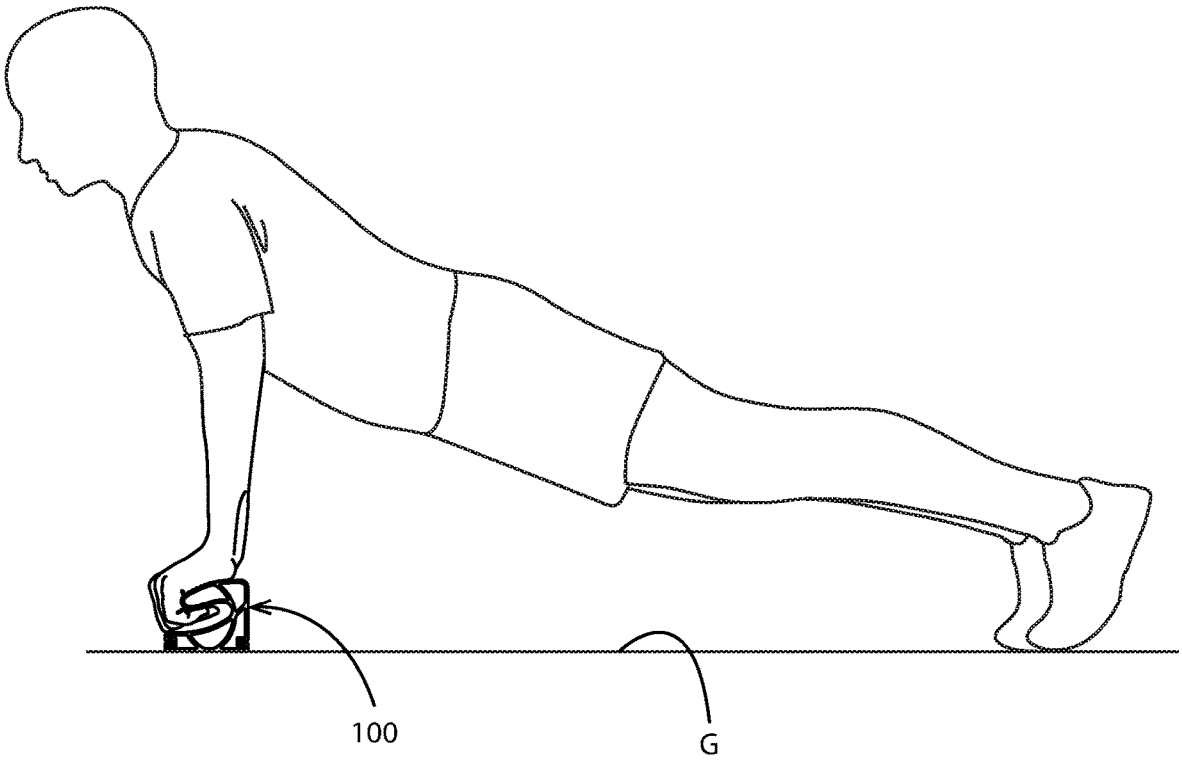
FIG. 6 is a side view of the apparatus demonstrating the push up starting position and how the user's hands will grip the apparatus.
Figure 7:
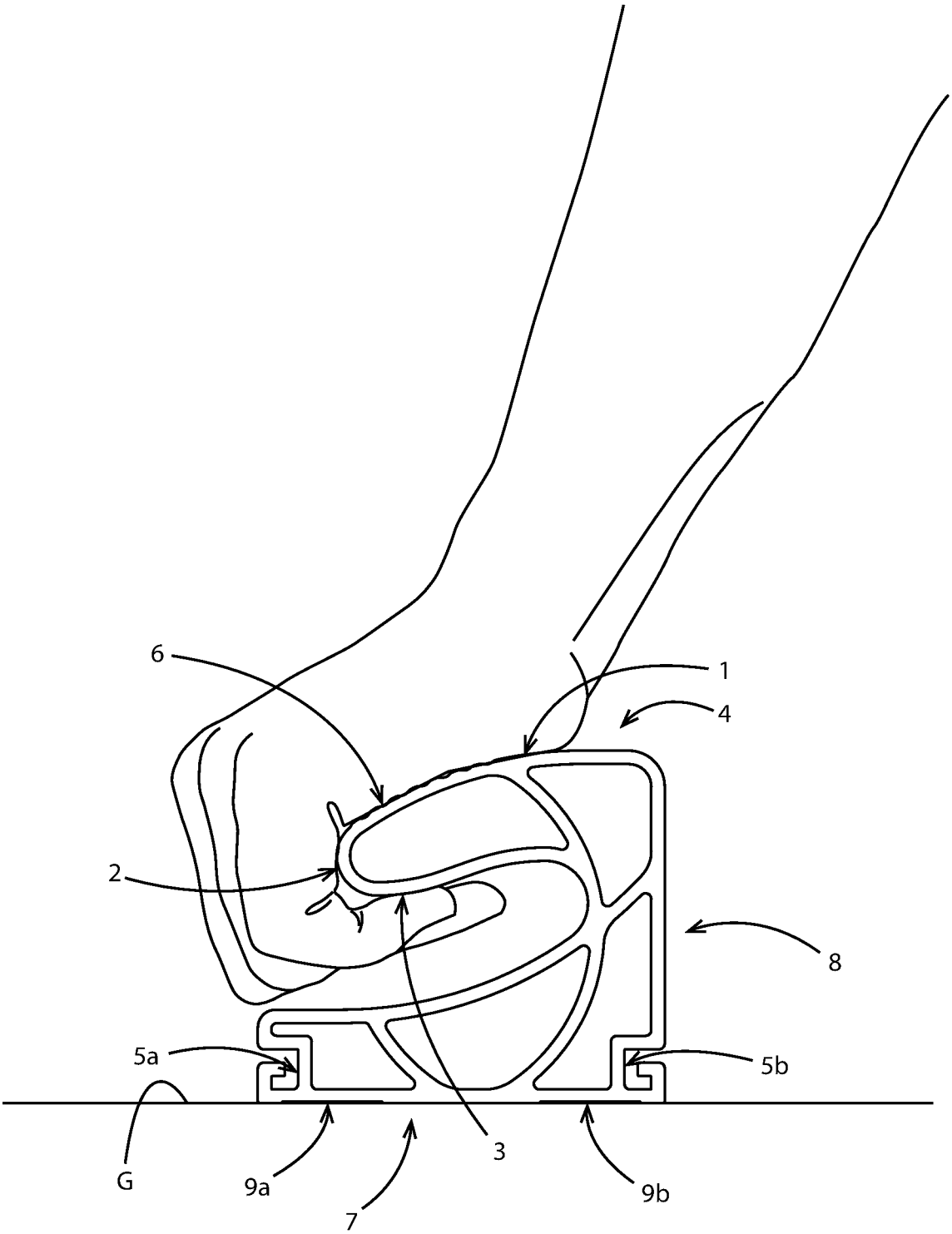
FIG. 7 is a side view of the apparatus showing, in detail, how the user's hand will grip the apparatus.
Figure 8:
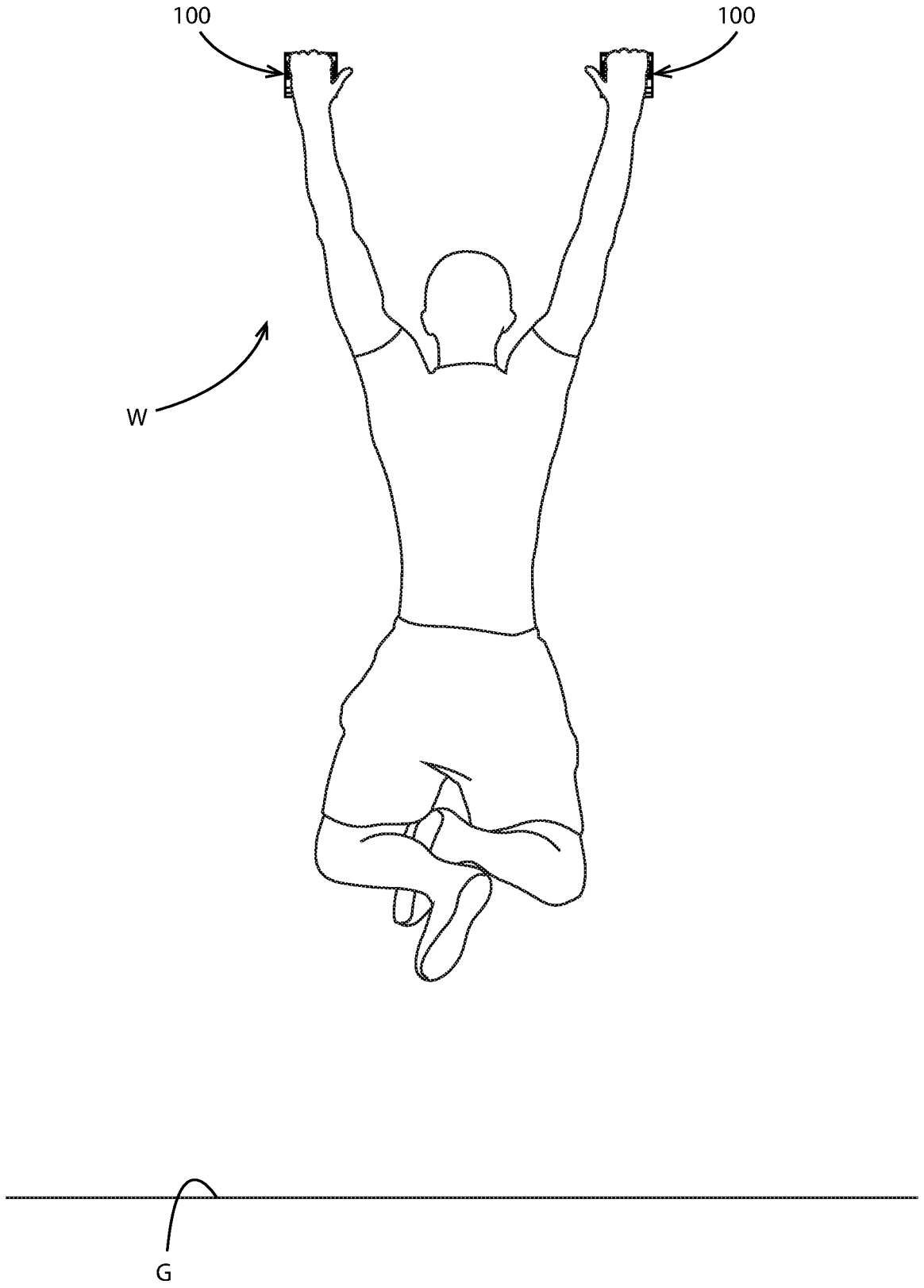
FIG. 8 is a front view of the apparatus in one embodiment where the apparatus hangs from the wall, demonstrating the hanging position of the user.
Figure 15:
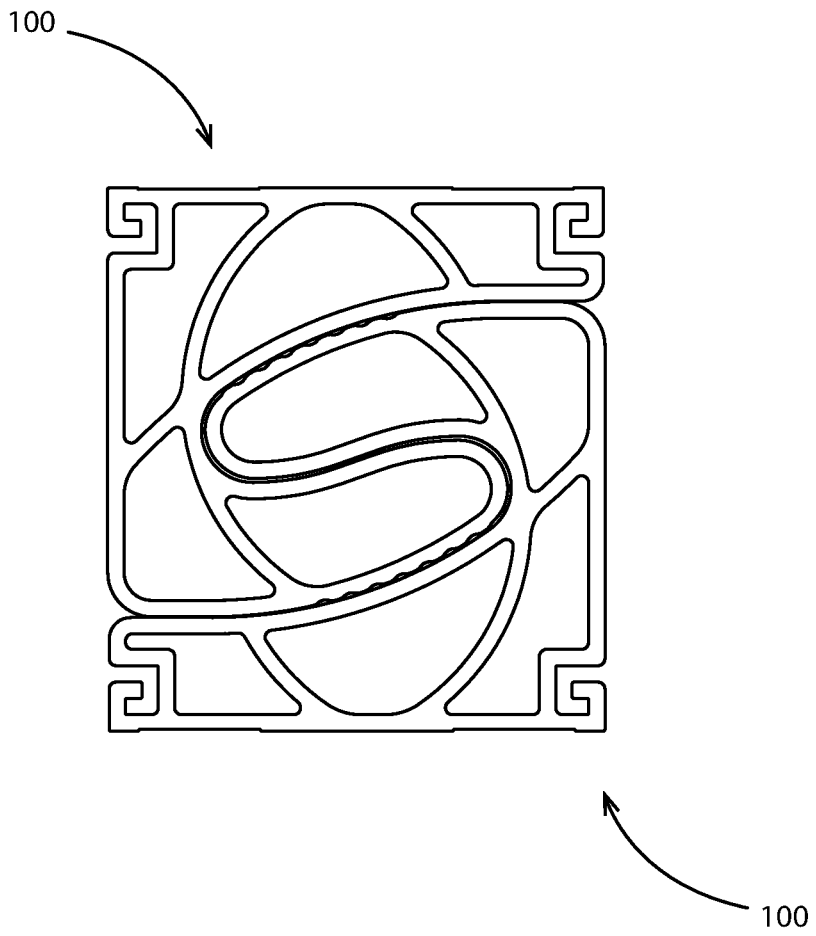
FIG. 15 is a side view of the preferred embodiment of the apparatus in the storage position with the two pieces locked together.

Preferably, the apparatus is built from two individual pieces (100) of aluminum that are shaped so that the two pieces interlock together as a stackable block for easy storage (as shown in FIG. 15). As shown in FIG. 1, the hand surface (1) of each individual piece of the apparatus (100) is angled downward, from the back of the apparatus (8) to the front, at an angle of approximately 20 degrees, although the exact angle of the piece may be different in various other embodiments. The heel of the palm is placed at the back of the hand surface (4); the front of the palm rests on the textured top of the hand surface (6); the fingers curl around the front of the hand surface (2) and grip the underside of the hand surface (3) for greater stability during use. The method of gripping the piece is shown in detail in FIG. 7. The width and depth of the hand surface (1), for the two individual pieces (100), adequately supports the heel of the palm as well as the majority of the width of the palm. The width and depth of the base (7), for the two individual pieces (100), provides adequate stability for the safe use of the apparatus during exercise. The base of the apparatus (7) has two channels (9(*a*)) and (9(*b*)) running the width of the piece where some form of grip tape may be mounted to reduce the likelihood of the base slipping on the floor (G).

Figure 9:
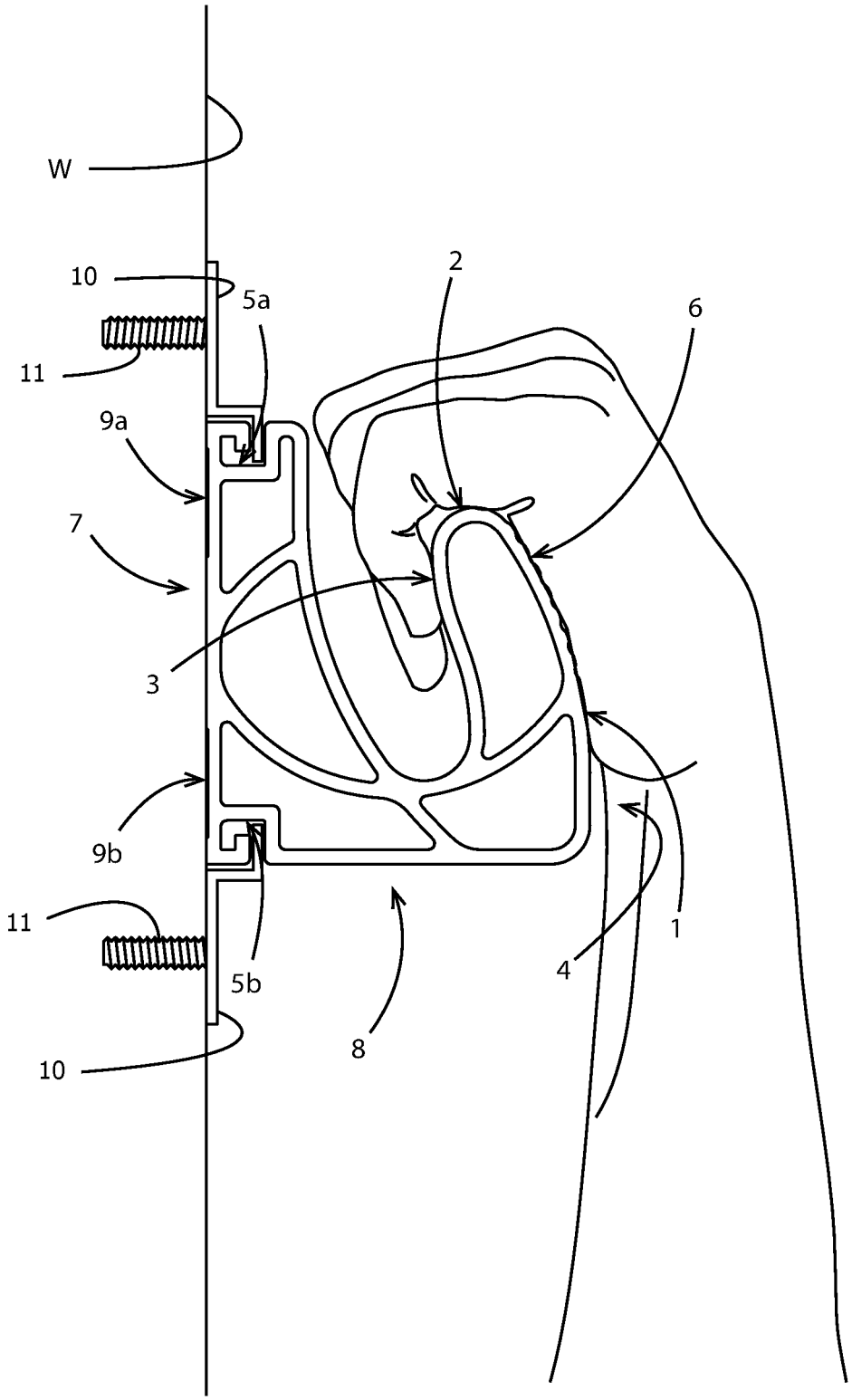
FIG. 9 is a side view of one embodiment where the apparatus hangs from the wall by interlocking with a bracketing system and showing how the user's hands will grip the apparatus in this position.
Figure 10:
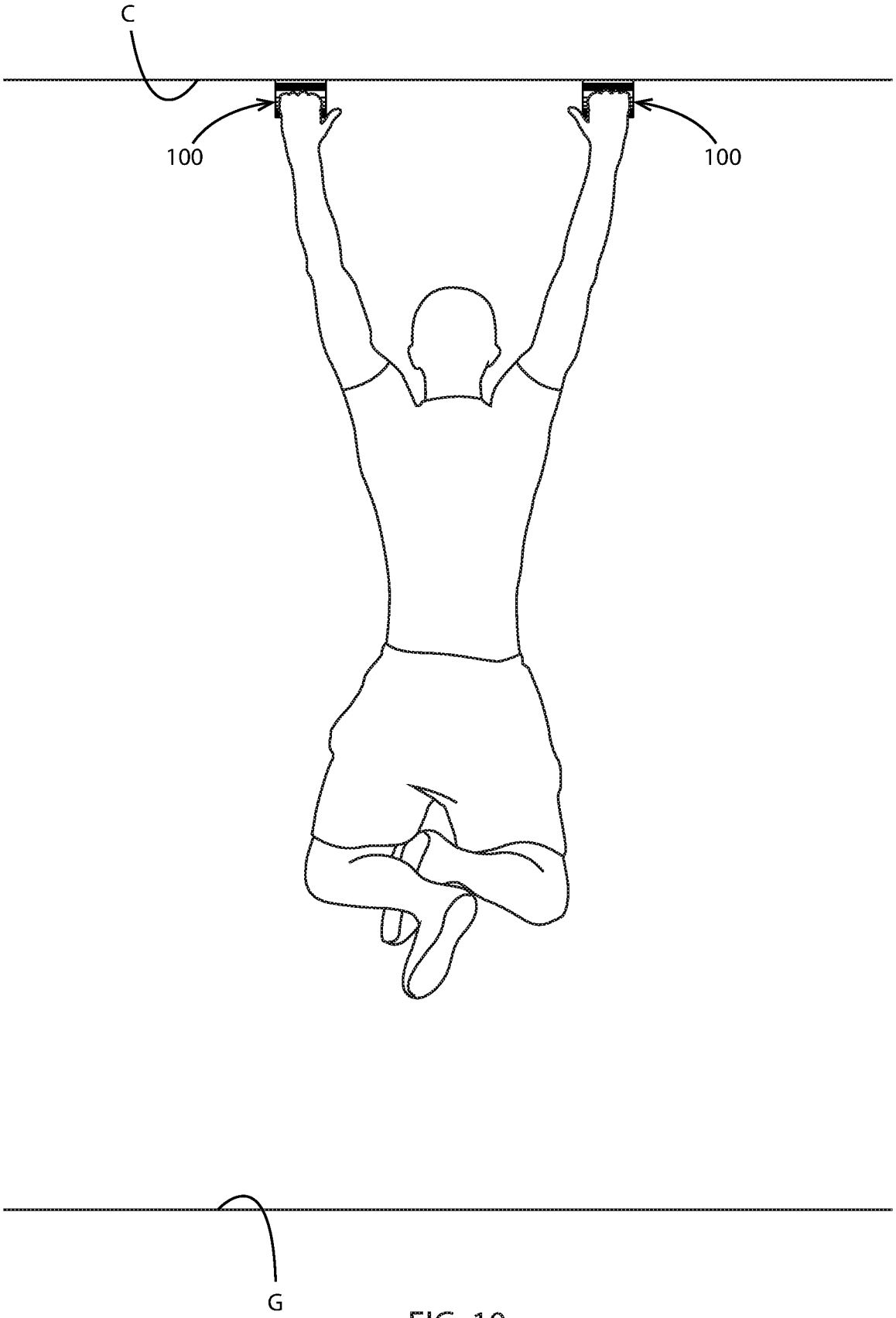
FIG. 10 is a front view of the apparatus in one embodiment where the apparatus hangs from the ceiling, demonstrating the hanging position of the user.
Figure 11:
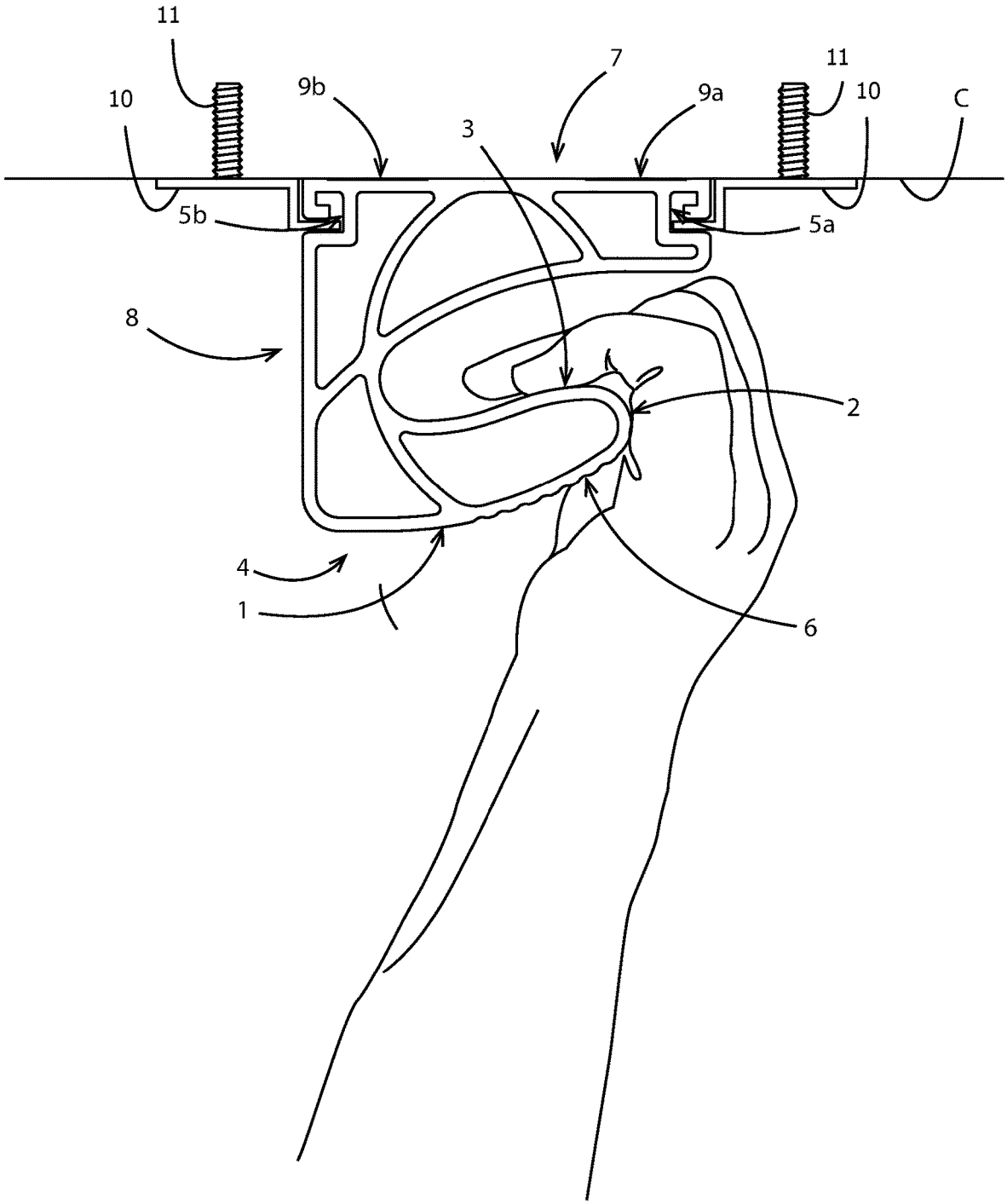
FIG. 11 is a side view of the apparatus in one embodiment where the apparatus hangs from the ceiling, demonstrating the user's grip when hanging in this position.
Figure 12:
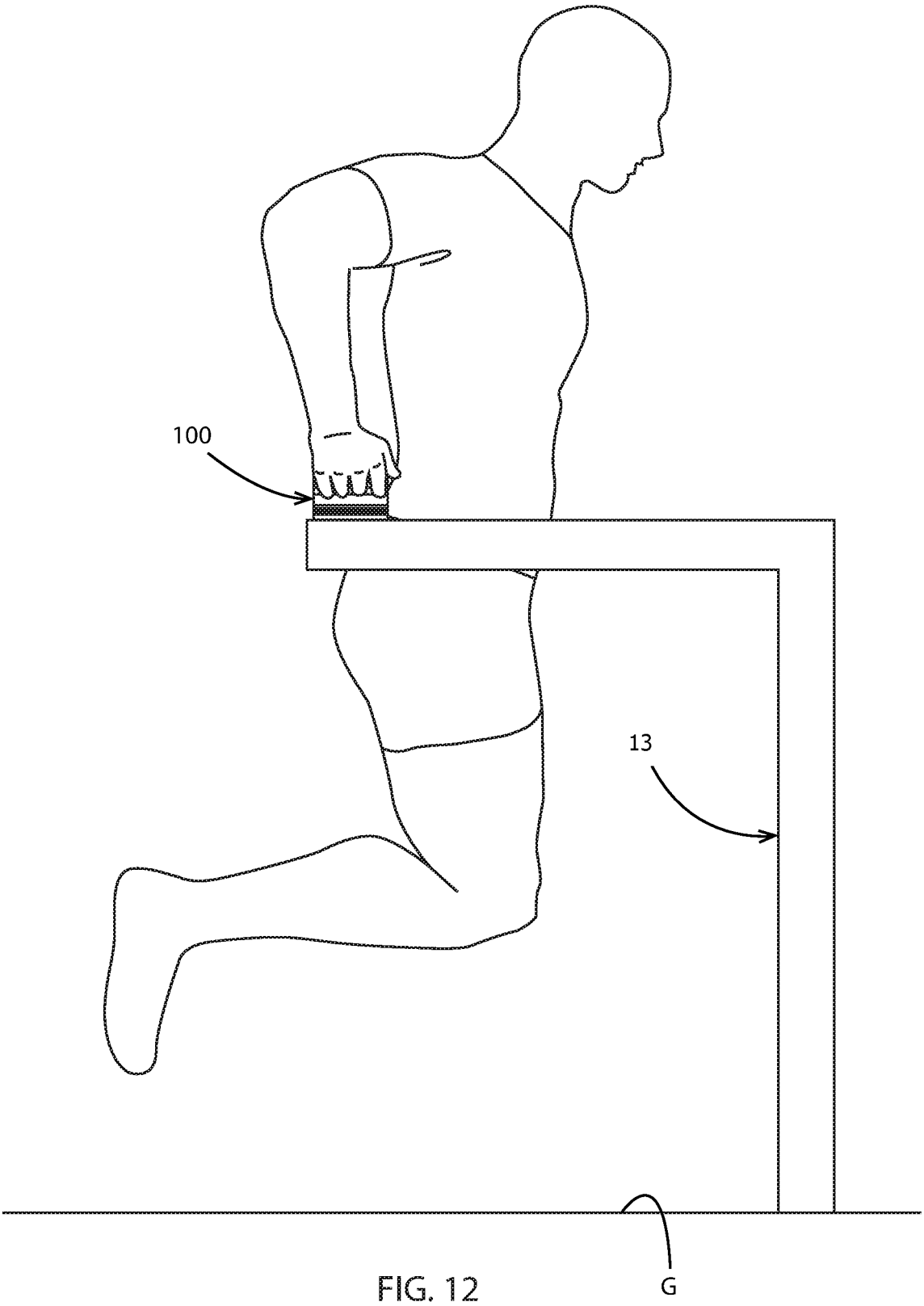
FIG. 12 is a side view of the apparatus in one embodiment where the apparatus is mounted to a horizontal surface or bar and showing the user's position when performing a chest dip.
Figure 13:
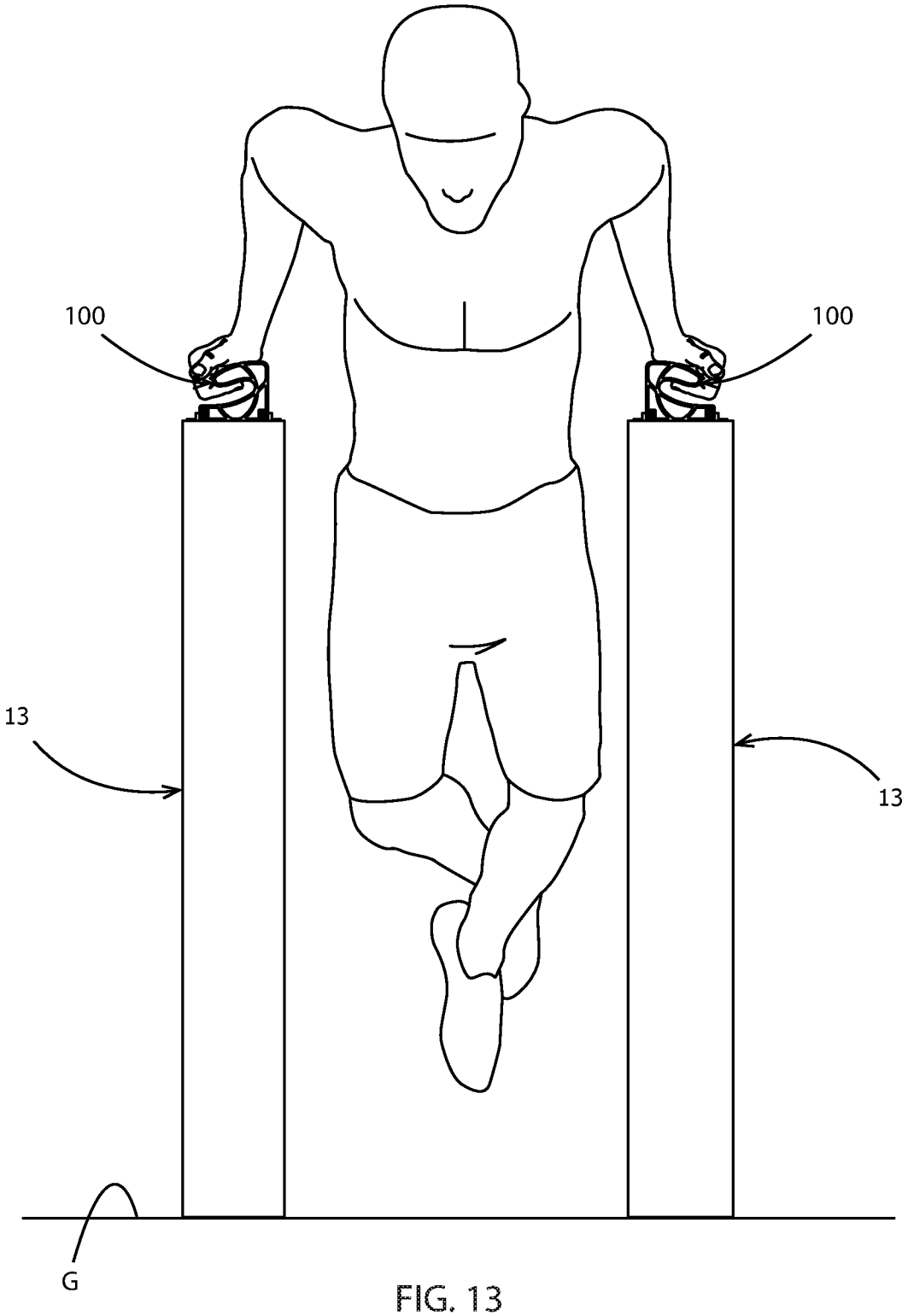
FIG. 13 is a front view of the apparatus in one embodiment where the apparatus is mounted to a horizontal surface or bar and showing the user's position when performing a chest dip.
Figure 14:
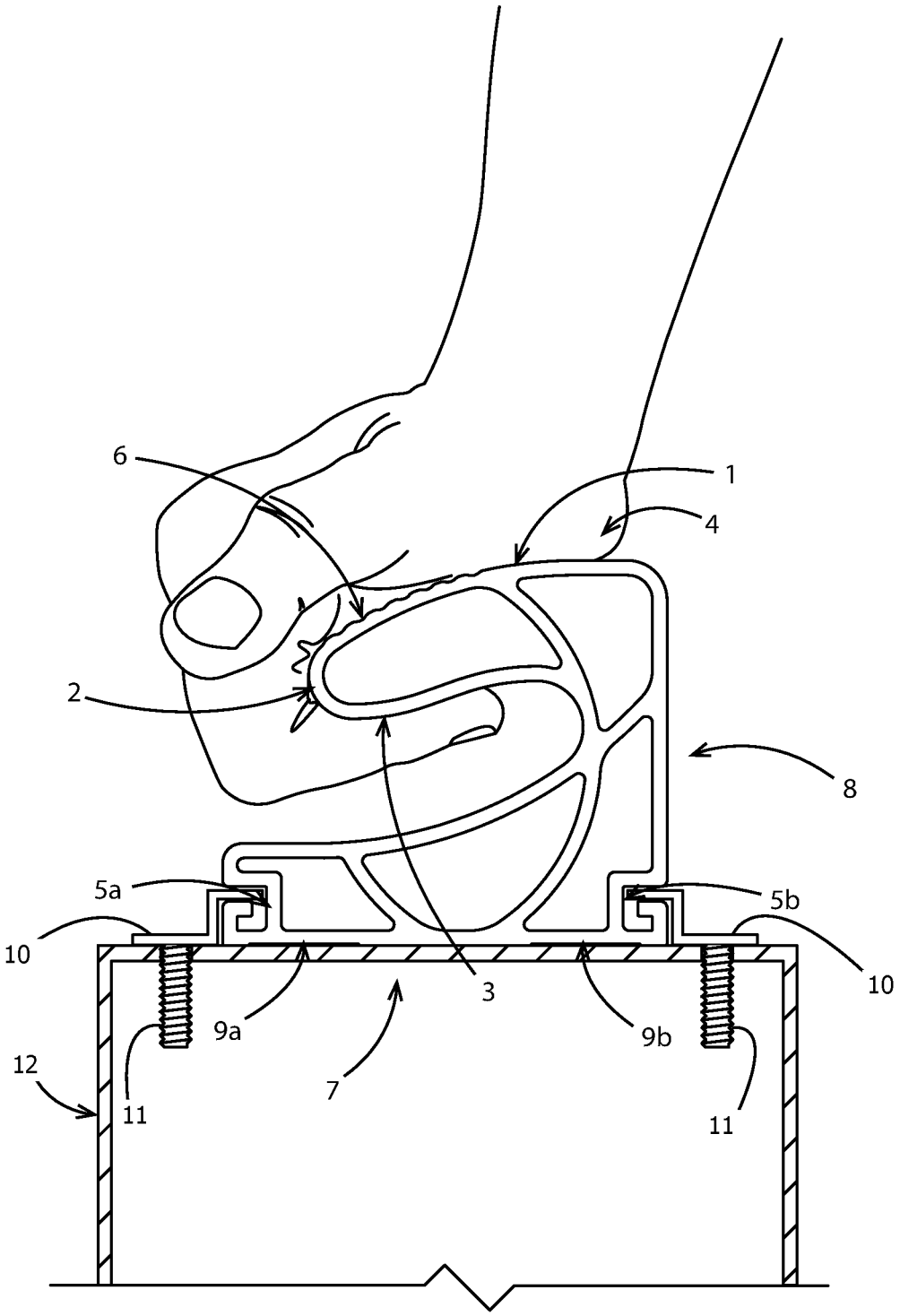
FIG. 14 is a side view of the apparatus in one embodiment where the apparatus is mounted with a bracketing system to a horizontal surface and showing the user's hand position when performing a chest dip.

In the preferred embodiment of the invention the base of the apparatus 7 includes slotted channels at the front and back (5(*a*)) and (5(*b*)) to accommodate a bracketing mechanism for mounting the apparatus on a wall (W) or ceiling (C) as shown in FIG. 9 and FIG. 11. FIGS. 9, 11, and 14 represent an example of one form of bracketing system wherein (10), the bracket, is mounted to the wall (W) or ceiling (C), with bolts (11). Said slotted channels will also allow the apparatus to be mounted to a flat horizontal surface (12) to assist with chest dips as shown in FIGS. 13 & 14 where said surface is attached to some form of vertical post or pillar (13).

An additional embodiment of the invention will be one longer piece of material (200) at an adequate width to accommodate a natural position of both arms, shoulders, and hands when in the push-up, plank, or mountain climber position (FIG. 15). The single, long piece varies from the preferred embodiment comprised of separate, independent, parts (100) for each hand. However, the embodiment of the one long piece may share the same, various, embodiments of all other aspects of the invention.

Various embodiments of the invention concern the angle of the hand surface. In various embodiments, the angle may be adjusted by the user using a locking system to allow the user to manually adjust the angle of the surface to suit their needs. In other embodiments, this angle may be adjusted automatically by the apparatus based on the user's unique weight, body position, body geometry, and mobility.

Various embodiments of the invention concern the connection of the hand surface to the base of the apparatus. In the preferred embodiment of the invention the hand surface and the base of the apparatus are constructed from one complete piece of material. In other embodiments of the invention, the hand surface is connected to the base by a fastening mechanism such as, but not limited to, a bolt, pin, clip, or clamp.

Figure 16:
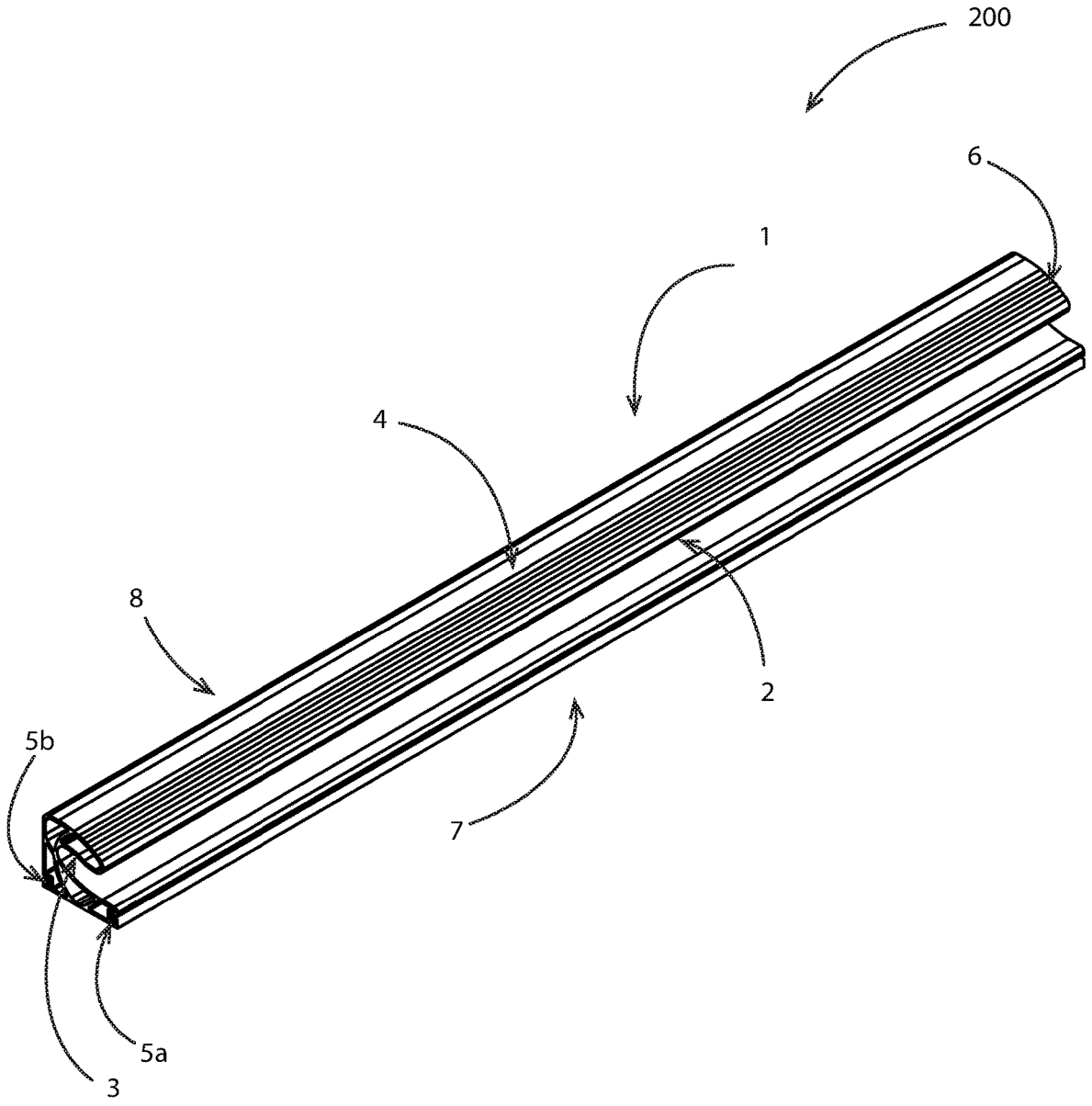
FIG. 16 is a view of one embodiment of the apparatus wherein the apparatus is comprised of one long bar instead of two independent pieces.
Figure 17:
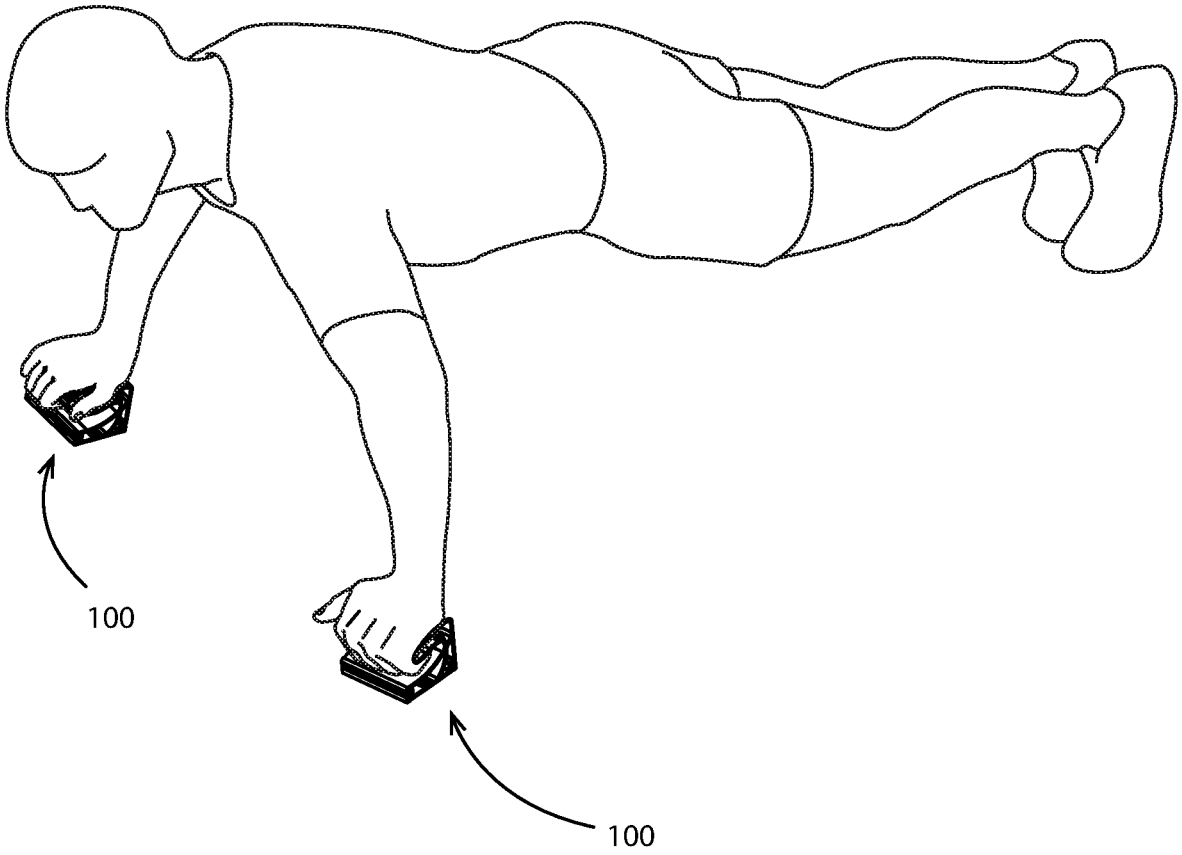
FIG. 17 is an isometric view of the apparatus demonstrating the push up position of the user using the embodiment wherein the apparatus is comprised of two independent pieces.

Various embodiments of the invention concern the safe and easy storage of the apparatus. In the preferred embodiment the two independent pieces (100) of the invention are designed to fit together by turning one piece upside down and sliding the two pieces together from the side, with the pieces locking together when the hand gripping surfaces interlock (FIG. 16). This allows the two pieces of the apparatus to be conveniently stacked for easy storage. In various other embodiments of the invention, the apparatus may be folded flat and stacked in a fashion similar to a folding chair.

The preferred embodiment of the invention will be constructed from aluminum with a wall thickness of approximately ⅛". Various other embodiments may be constructed of any material commonly used in the manufacture of exercise equipment including, but not limited to, wood, metal, plastic, silicone, and neoprene. These various embodiments may be hollow, as in the preferred embodiment, or made from a solid material.

In various embodiments of the invention, the hand surface (1) may have a non-slip element to ensure that the user's palms do not slip off said surface during use. This non-slip element may consist of a texturing of the material's surface, as shown in FIG. 1 item 6, a special coating such as urethane, neoprene, epoxy resin, anti-slip paint, or a non-slip decal or pad placed on the surface of the material.

The apparatus may be of solid construction of any number of different materials, but the preferred embodiment is manufactured from aluminum with a wall thickness that may vary but is of approximately ⅛ of an inch so that the centre of the apparatus is hollow.

The embodiments of the invention in which an exclusive property or privilege is claimed are defined as follows:

1. An exercise apparatus for aiding wrists during exercise comprising:

at least one piece comprising:

a rectangular base adapted to engage with a surface and having a first end and a second end;

a sidewall arranged at the second end of the rectangular base and extending outwardly and perpendicularly from the rectangular base; and a hand surface connected to the sidewall and arranged spaced apart from the rectangular base and extending obliquely and downwardly from the sidewall towards the first end of the base, the hand surface is configured to fit an entire width of an average adult palm and more than 30% of a length of said palm, from a heel to a base of fingers of a user, the hand surface includes an underside arranged facing the rectangular base, a top side arranged opposite to the underside, and a front edge connecting the underside to the top side and allows fingers of the user to grip the hand surface.

2. The apparatus of claim 1, wherein the top side of said hand surface has a convex shape.

3. The apparatus of claim 1, wherein the underside of said hand surface has a concave shape.

4. The apparatus of claim 1, wherein the front edge of said hand surface has a rounded edge to improve the user's grip during use by allowing the fingers to comfortably curl over said front edge.

5. The apparatus of claim 1, further comprising: a non-slip material or texture covering said hand surface.

6. The apparatus of claim 1, wherein the rectangular base defines two channels for placement of non-slip grip material.

7. The apparatus of claim 6, wherein the non-slip grip material includes two strips of grip tape or foam padding.

8. The apparatus of claim 1, further comprising a non-slip material or texture covering all or a portion of the rectangular base.

9. The apparatus of claim 1, wherein the hand surface includes ridges and indents to provide comfortable positioning of each finger of a hand of the user.

10. The apparatus of claim 1, wherein the at least one piece is a single piece to allow the user to place both hands on the hand surface.

11. The apparatus of claim 1, further comprising: two independent pieces, one for each of the user's hands.

12. The apparatus of claim 11, wherein: both independent pieces can be locked together when not in use to create one unit for easy storage.

13. The apparatus of claim 1, wherein the rectangular base includes slotted channels to facilitate a mounting of the piece on a wall or a ceiling so that said apparatus may be used for hanging or pulling-type exercises.

* * * * *